US008043642B2

(12) United States Patent
Schõnemann

(10) Patent No.: US 8,043,642 B2
(45) Date of Patent: Oct. 25, 2011

(54) METHOD AND COOKING APPLIANCE FOR REGULATING A COOKING PROCESS IN A COOKING CHAMBER

(75) Inventor: Konrad Schõnemann, Sulzfeld (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 213 days.

(21) Appl. No.: 12/502,483

(22) Filed: Jul. 14, 2009

(65) Prior Publication Data

US 2009/0274805 A1 Nov. 5, 2009

Related U.S. Application Data

(63) Continuation of application No. PCT/EP2008/000014, filed on Jan. 3, 2008.

(30) Foreign Application Priority Data

Jan. 15, 2007 (DE) ..... 10 2007 003 225

(51) Int. Cl.
*A23L 1/01* (2006.01)

(52) U.S. Cl. ..... 426/233; 426/523; 219/707

(58) Field of Classification Search ..... 426/231–233, 426/523; 99/325, 332; 219/707
See application file for complete search history.

(56) References Cited

U.S. PATENT DOCUMENTS 4,162,381 A * 7/1979 Buck ..... 219/705
4,335,293 A 6/1982 Kobayashi et al.
4,500,870 A 2/1985 Krohn et al.
4,864,088 A 9/1989 Hiejima et al.
5,349,163 A * 9/1994 An ..... 219/492
5,369,253 A * 11/1994 Kuwata et al. ..... 219/707
5,681,496 A 10/1997 Brownlow et al.
6,497,907 B2 * 12/2002 Hofer ..... 426/233
6,498,326 B1 12/2002 Knappe
7,075,041 B2 * 7/2006 Kruempelmann et al. ... 219/497
7,811,616 B2 * 10/2010 Schonemann et al. ..... 426/233
7,923,664 B2 * 4/2011 Kruempelmann et al. ... 219/490
2003/0178291 A1 9/2003 Schilling
2005/0061799 A1 3/2005 Kruempelmann et al.
2007/0289962 A1 12/2007 Kruempelmann et al.
2008/0008808 A1 1/2008 Schonemann et al.
2008/0017046 A1 1/2008 Huber et al.
2008/0193614 A1 * 8/2008 Greiner et al. ..... 426/231
2008/0236404 A1 * 10/2008 Ose et al. ..... 99/327

OTHER PUBLICATIONS

International Search Report for PCT/EP2008/000014 dated Jan. 3, 2008.
Office Action from corresponding U.S. Appl. No. 12/557,755 dated May 10, 2011.
Office Action dated Sep. 9, 2010 from corresponding Chinese Patent Application No. 200880016366.0.

* cited by examiner

*Primary Examiner* — Drew E Becker
(74) *Attorney, Agent, or Firm* — Alston & Bird LLP

(57) ABSTRACT

In one embodiment for regulating a baking process in an oven, an operator introduces a product to be cooked into the oven, and a sensor detects a gas or moisture concentration release from the product cooking in the cooking chamber over time wherein The slope of the curve of the detected concentration is determined, and a trigger value that is linked to the product to be cooked is determined for the slope. The point in time at which the trigger value will be reached is determined, and an additional time linked to said point in time is determined at the point in time at which the trigger value is reached. The additional time depends on the point in time at which the trigger value is reached. The additional time is continued as an additional process until the additional time has elapsed in case the trigger value is not reached.

12 Claims, 3 Drawing Sheets

METHOD AND COOKING APPLIANCE FOR REGULATING A COOKING PROCESS IN A COOKING CHAMBER

CROSS REFERENCE TO RELATED APPLICATIONS

This application is a continuation of PCT/EP2008/000014, filed Jan. 3, 2008, which in turn claims priority to DE 10 2007 003 225.2, filed on Jan. 15, 2007, the contents of both of which are incorporated by reference.

FIELD OF THE INVENTION

The invention relates to a method of regulating a cooking process for a foodstuff in a cooking chamber of a cooking appliance, such as an oven with heating means and a gas sensor. The invention additionally relates to a cooking appliance designed for this purpose.

BACKGROUND OF THE INVENTION

U.S. Patent Publication 2008/0008808 discloses in general a method of regulating cooking processes in a cooking chamber, in which a gas concentration in the cooking chamber is detected using a sensor.

It is known from U.S. Pat. No. 7,075,041 for a method of controlling a cooking process to involve detection of a gas concentration in the cooking chamber with a sensor during the cooking process. In order to compensate sensor drift, the gradient of the gas concentration detected is here observed. It is furthermore determined when the current gradient has fallen to a particular proportion of the maximum gradient, this ratio, or cooking quotient, possibly depending on the foodstuff to be cooked. If a corresponding cooking quotient is reached, the cooking process is regarded as complete and is stopped or heating of the cooking chamber is interrupted. A disadvantage here, however, is that interruptions to the cooking process, caused for example, by opening access to the cooking chamber, may change the ratios. However, this cannot be taken into account in the method described, such that the results obtained may be less then desired.

The problem underlying the invention is that of providing an above-mentioned method and an above-mentioned cooking appliance which allow prior art problems to be avoided and which in particular function as well as possible and by means of which satisfactory results may be achieved as the outcome of a largely automated cooking process.

BRIEF SUMMARY

This problem is solved in one embodiment by a method having the features of the claims. Advantageous and preferred developments of the invention are the subject matter of the further claims and are explained in greater detail below. The wording of the claims is incorporated by express reference into the content of the description.

According to one embodiment of the invention, the method comprises the following steps:

a) input of a foodstuff indicator to be cooked by an operator into a controller of said cooking appliance;
b) detection by said sensor of a concentration over time of a gas or of moisture escaping from said foodstuff in said cooking chamber after said foodstuff has been introduced;
c) determination of a gradient of a profile of said detected concentration over the course of time;

d) reading out of a trigger value linked to said foodstuff to be cooked for said profile from a memory of said controller;
e) determination of the time at which said trigger value is reached or fallen below;
f) determination of a run-on time linked to a time at which said trigger value is reached for said foodstuff from said memory at said time at which said trigger value is reached, a length of a run-on time being a function of said time at which said trigger value is reached;
g) starting of said run-on time; and
h) continuation of said cooking process as a run-on process until said run-on time has elapsed if said value remains below said trigger value.

These and further features follow not only from the claims but also from the description and the drawings, the individual features being realized in each case alone or several together in the form of sub-combinations in an embodiment of the invention and in other fields and may constitute advantageous, per se protectable embodiments, for which protection is here claimed. Subdivision of the application into individual sections and intermediate headings does not limit the general applicability of the statements made thereunder.

BRIEF DESCRIPTION OF THE DRAWINGS

Exemplary embodiments of the invention are illustrated schematically in the drawings and explained in more detail below, wherein.

DETAILED DESCRIPTION OF THE EXEMPLARY EMBODIMENTS

Figure 1:
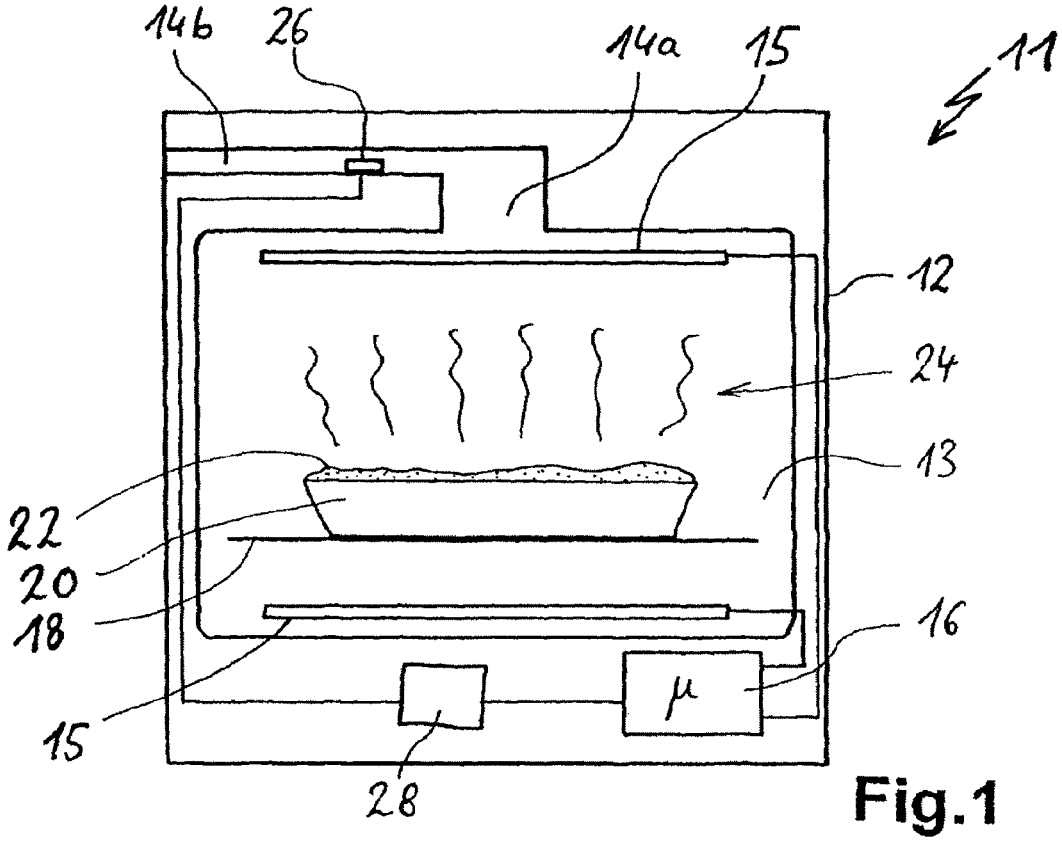
FIG. 1 is a schematic representation of an oven according to one embodiment of the invention with gas sensor and controller.

An indication of a foodstuff to be cooked is input by an operator into a controller of the cooking appliance. This may be effected either by direct manual input using operating elements and optionally with menu navigation, or alternatively the foodstuff may be at least in part automatically read in by the cooking appliance, for example using barcode technology or RFID technology on foodstuff packaging.

Using a gas sensor, which is arranged in the cooking chamber or connected thereto, it is possible to detect over time the concentration of a gas or of moisture in the cooking chamber that escapes from the foodstuff introduced therein after the start of the cooking process.

The profile over time of the gradient of this detected concentration of gas or moisture in the cooking chamber is determined by formation of the first derivative of the concentration profile.

On the basis of which foodstuff to be cooked is input, a trigger value linked with this foodstuff is read out from the controller or from a memory means of the controller.

It is determined at what time in its profile over time the gradient reaches the trigger value or falls below the trigger value, conventionally from a higher value.

On the basis of this time at which the trigger value is reached, a run-on time linked to this time and applicable to this foodstuff may be determined from the memory means or in the controller. This run-on time, or the length thereof, is dependent in this case on the time at which the trigger value is reached. A more detailed explanation of this is given below.

After the time at which the trigger value is reached, the run-on time starts, or the cooking process is continued for the duration of the run-on time.

The cooking process is continued or keeps going over the run-on time as a run-on process until the run-on time has elapsed, this applying if the gradient remains below the trigger value or the trigger value is not reached again. A more detailed explanation of this is also given below.

It is thus possible, in contrast with the above-stated U.S. Pat. No. 7,075,041, to conclude the cooking process not simply after a given value has been reached for the gradient of the concentration of gas or moisture. Instead, it is possible, depending on when this given value was reached, for the cooking process to be continued for a given time. It is thus also possible to take account of the fact that the occurrence of the gases or moisture in the cooking chamber and thus also the concentrations thereof do not only depend absolutely on the foodstuff itself, but rather for example also on the quantity of the foodstuff or the type or size of the foodstuff container in which the foodstuff is located. It may thus be of great importance, for example in the case of cakes, whether the same cake mixture is prepared as the foodstuff either in a wide, shallow cake tin or instead in a narrow, tall cake tin.

Moreover, the problem often arises that external disturbance, such as for example opening of the cooking chamber door or uneven operation of a fan in a cooking appliance, may change significantly the concentration and thus also the profile over time thereof. It has thus proven sensible, for the purposes of the invention, not only to observe the occurrence of a termination condition as a given fraction of a maximum value of the gradient of the concentration but also to take into account the time of this occurrence. As a function of this time, it may for the purposes of the invention still be ensured by the run-on time that a foodstuff is properly cooked.

In one embodiment of the invention, not every possible individual foodstuff is distinguished between or stored individually in a controller but rather specific foodstuff groups are put together. Thus both the configuration of the controller and inputting of data by an operator may be considerably simplified. It is not necessary to input every possible individual dish or foodstuff, which do not therefore for example have to be found in a list, but rather input may proceed more rapidly and simply by division into generalised foodstuff groups. Such foodstuff groups comprise for example sponge cakes or fruit cakes in the case of cakes, roasts, savory baked dishes or the like in the case of other dishes. Specifications for determining the run-on time may then be stored for each foodstuff group in the cooking appliance controller or an associated memory means. A foodstuff may then basically be treated as belonging to the corresponding foodstuff group, i.e., for example, no longer as a particular type of sponge cake but rather as a sponge cake in general.

For the above-stated trigger value, the time at which it is reached being of significance, may be considerably lower than the maximum gradient. It may amount for example to 10% to 40% of the maximum gradient, in particular approximately 15% to 20%. In this way, it is ensured that the gradient of the gas concentration or of the moisture in the cooking chamber has already become slight but at the same time is still increasing to a degree.

If the time at which the trigger value is reached is under 30 minutes, in particular under 20 minutes, according to a first embodiment of the invention the run-on time may amount to a fixed value. It may amount, for example, to 10 minutes to 15 minutes. This means therefore that, if the trigger value is reached in a relatively short time, cooking continues for a run-on time which is not much shorter in comparison thereto.

In an alternative embodiment of the invention, it is possible for the run-on time not to amount to a fixed value for such a relatively early time at which the trigger value is reached, i.e., less than 30 minutes or less than 20 minutes, but rather to amount to a value which still changes relatively slightly. It may then be approximated by a straight line with a slight gradient, in particular a falling straight line. In this way, account may be taken of the fact that if the trigger value is reached very rapidly after just a few minutes, the run-on time is somewhat longer than if it takes place only after 15 minutes to 20 minutes.

If the time at which the trigger value is reached is more than 20 minutes or more than 30 minutes, the run-on time may be reduced or be more severely reduced than before. At a time of 90 minutes at the latest, or even 70 minutes at the latest, it may be set to zero or amount to zero or indeed a very low value. In this way, account is taken of the fact that the vast majority of dishes or foodstuffs or foodstuff groups are fully cooked after 90 minutes or even after 70 minutes. It goes without saying that it is also possible to input some foodstuff groups with a significantly longer basic cooking time, a certain run-on time then possibly still being provided.

In a further development of the invention, the run-on time is determined by means of a curve which falls strictly monotonically at least in the above-stated decreasing region. This curve is advantageously a straight line or at least approximately a straight line. It is relatively simple to determine the run-on time on the basis of a straight line or straight sections.

Provision may be made for the cooking process to be regarded as complete and terminated if the run-on time, on the basis of the trigger value or the time at which it is reached, is set at zero. Run-on times which deviate from zero then bring about continuation of the cooking process at least for this short time, in accordance with the above steps g) and h).

In addition to the condition from step h), provision may be made in the case of the trigger value being reached again or exceeded, this time from below, for the run-on process to be broken off and the run-on time to be abandoned in the process. Such re-reaching or exceeding of the trigger value means that namely either a process predetermined for this foodstuff on the basis of type or, in most cases, an external disturbance or an external influence, has occurred. By breaking off the run-on process or abandoning the run-on time, the normal cooking process is, as it were, resumed. If then the trigger value is again reached, a run-on time is again determined, as a function of the time at which said value was reached, and the run-on process is started again, with steps c) to h) then substantially being performed.

A cooking appliance with which the above-described method may be performed, in particular an oven, may comprise a cooking chamber with heating means and a gas sensor in the cooking chamber or on the cooking chamber. While the heating means may be a conventional heating means for corresponding cooking appliances or ovens, this also applies in principle to the gas sensor. In one embodiment, the gas sensor is advantageously a moisture sensor that detects the concentration or the profile over time of the moisture in the cooking chamber. Alternatively, a gas sensor may be designed for carbon dioxide, oxygen or particular aroma gases that monitors the profile over time thereof.

The cooking appliance advantageously comprises a memory means, which is connected to the controller of the cooking appliance or incorporated therein. Various values for the trigger value may be stored in this memory means for different foodstuff groups, reaching of this value being crucial to the method according to the invention. Moreover, various specifications for determining the run-on time may be stored therein, for example by linking together or correlating the time at which the trigger value is reached and the run-on time by way of a curve. Such a curve may in particular be composed of straight sections for a simple determination specification. For example, such a curve may comprise three portions or segments. A first segment may comprise a slight or slightly falling gradient or no gradient at all. An adjacent second segment may have a more severely falling gradient. An adjacent third segment may in turn comprise a very slightly falling gradient or no gradient and tend substantially towards zero or amount to zero. A possible curve of this type takes the form of a type of slope, which falls away.

Turning now to the figures, FIG. 1 is a schematic representation of an oven 11 with an oven chamber 13 and a wall 12. In the chamber 13 there is arranged an oven heating means 15 with top and bottom heating, which is connected to an oven controller 16. On a shelf 18 in the chamber 13 there is situated a cake tin 20 with a cake mixture 22 therein as foodstuff. It may be noted how, as a result of heating by means of the oven heating means 15, gas 24 or a gas mixture escapes from the cake mixture 22 and may be detected by a gas sensor 26. This gas 24 contains various constituents, and may also mainly be moisture. By means of these constituents or their concentration the total cooking time is established or determined according to the invention, as will be explained in greater detail below. As has been explained above, the oven 11 or the controller 16 advantageously already knows at this point what the foodstuff is or that it is a particular cake mixture 22, because this was input at the start.

In the upper region of the chamber 13 a schematically illustrated steam outlet 14*a* is shown, which develops into a steam channel 14*b*, which leads out of the chamber 13 or the oven 11. The gas sensor 26 is arranged in the steam channel 14*b*, this being connected to sensor electronics 28. It is possible and even advantageous in certain embodiments of the invention to provide more than one gas sensor 26 or a plurality of such gas sensors.

Figure 2:
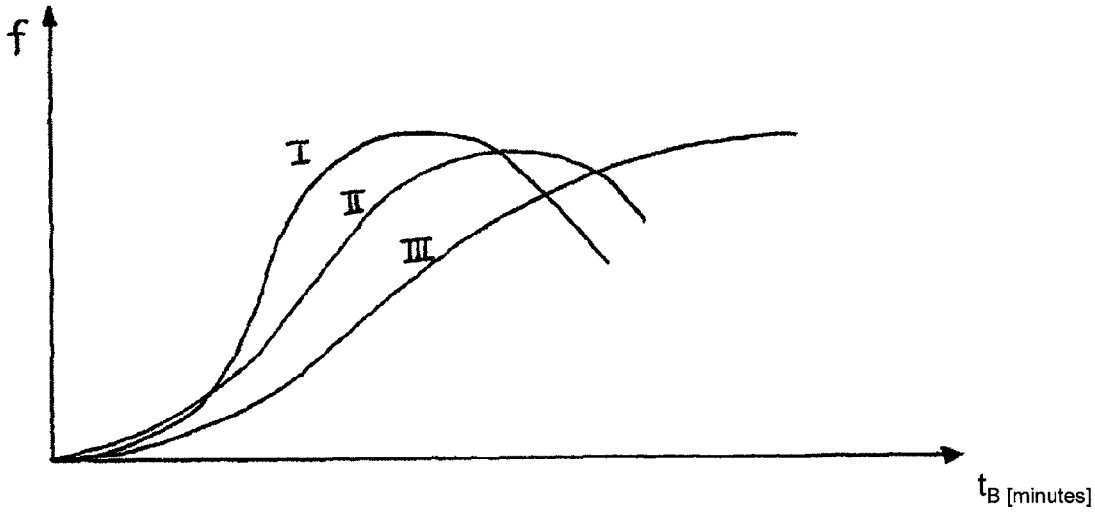
FIG. 2 shows various moisture profiles over time for cake mixture under different conditions.

FIG. 2 shows the moisture profile over the time $t_B$, i.e. over the cooking time. Three curves I to III are shown therein. Curve I is for a sponge cake mixture, a small quantity of mixture being prepared in a springform tin, i.e., a relatively small amount of mixture in a wide and rather shallow tin. It may be noted that the concentration of moisture "f" does not rise until somewhat later than in the other cases, but then does so relatively rapidly and steeply and falls back again after reaching a maximum at a gradient which is somewhat gentler than when it was rising prior to reaching the maximum.

The curve III is likewise a sponge cake mixture, a relatively large amount of dough having been prepared, this time in a loaf tin. This means that, in comparison with the curve I, the exposed surface of the mixture is considerably smaller in relation to the quantity of mixture than with curve I. The gradient for the concentration of moisture "f" is here significantly shallower than in the case of curve I, and a maximum value is reached only at a considerably later point. Finally, as is shown by the end of the curve III, the cooking process is also terminated before the maximum is exceeded or indeed actually reached.

A further curve II is shown for a sponge cake mixture which is prepared in a mould for a marble cake. This means that the exposed surface of the mixture is smaller than for the springform shown by curve I, but larger than for the loaf tin shown by curve III. In the case of curve II, the concentration of moisture rises more slowly than in the case of curve I, and also the maximum value is reached somewhat later. Otherwise, however, curve II resembles curve I.

Figure 3:
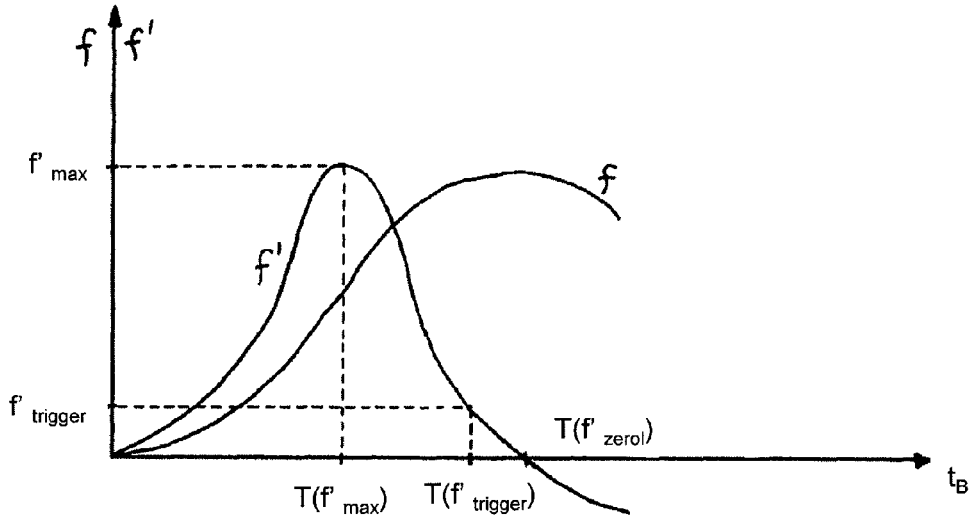
FIG. 3 shows the profiles over time both of moisture and the first derivative thereof for a cake mixture.

FIG. 3 once again relates to curve II, showing both the profile of the concentration of moisture f and the profile of the first derivative of the curve II over the baking time $t_B$, i.e., the curve f'. The profile of f' reaches a maximum value $f'_{max}$ at a time $T(f'_{max})$. A trigger value $f'_{trigger}$ belonging thereto or indeed to the foodstuff to be cooked or to the associated foodstuff group is reached somewhat later, namely at the time $T(f'_{trigger})$. Shortly thereafter, the profile f' passes through zero at $T(f'_{zero})$. FIG. 3 thus shows the continuous course of the baking process over the baking time $t_B$ when termination of the cooking process and a run-on time are not brought about as with the method according to the invention.

Figure 4:
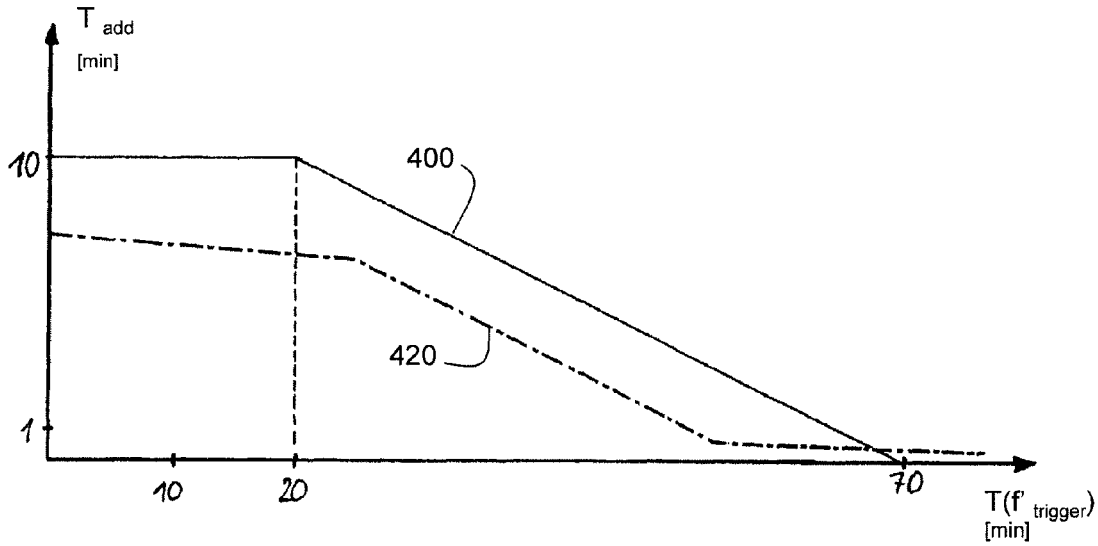
FIG. 4 shows two possible curves as specifications for determining run-on time.

FIG. 4 shows how the run-on time $T_{add}$ is calculated or how it is determined, specifically for the foodstuff or the foodstuff group associated with the curve II for the profile of the moisture concentration. For this curve II, the profile of the run-on time $T_{add}$ is shown as a continuous line 400. The curve for determining the run-on time $T_{add}$ is composed of two straight sections for a time at which the trigger value $T(f'_{trigger})$ is reached. Up to a time $T(f'_{trigger})$ of up to 20 minutes the run-on time $T_{add}$ is constant, amounting namely to 10 minutes. From that point it falls away steadily, until at 70 minutes it amounts to zero. This means therefore that, if the trigger value is only reached after 70 min or more, the run-on time is established or determined as zero or no run-on process takes place. The cooking process is thus terminated immediately once the trigger value is reached.

As an alternative to such a relationship between run-on time $T_{add}$ and the time at which the trigger value $T(f'_{trigger})$ is reached, a relationship may exist according to the dash-dotted curve 420. This dash-dotted curve also consists of assembled straight sections, but here there are three straight sections. Furthermore, the first straight section falls away slightly, such that even in the first region the run-on time $T_{add}$ is not constant but rather decreases slightly. This is adjoined by a more steeply falling region, which ends at a run-on time $T_{add}$ of approximately 1 minute. Then this is adjoined by a third straight portion, which makes its way slowly and continuously towards zero, such that then only a very short run-on time $T_{add}$ is provided. If therefore the run-on time $T_{add}$ is determined according to the dash-dotted curve, if the trigger value is reached at very late times such as 70 minute or even very much later, then a very short run-on time of somewhat less than 1 minute is still provided.

It is easy to imagine other alternatives for the interrelationships according to FIG. 4 between run-on time $T_{add}$ and the time at which the trigger value $T(f'_{trigger})$ is reached. These may either entail curve portions deviating from a straight profile or also possibly a rising portion as first straight portion.

Figure 5:
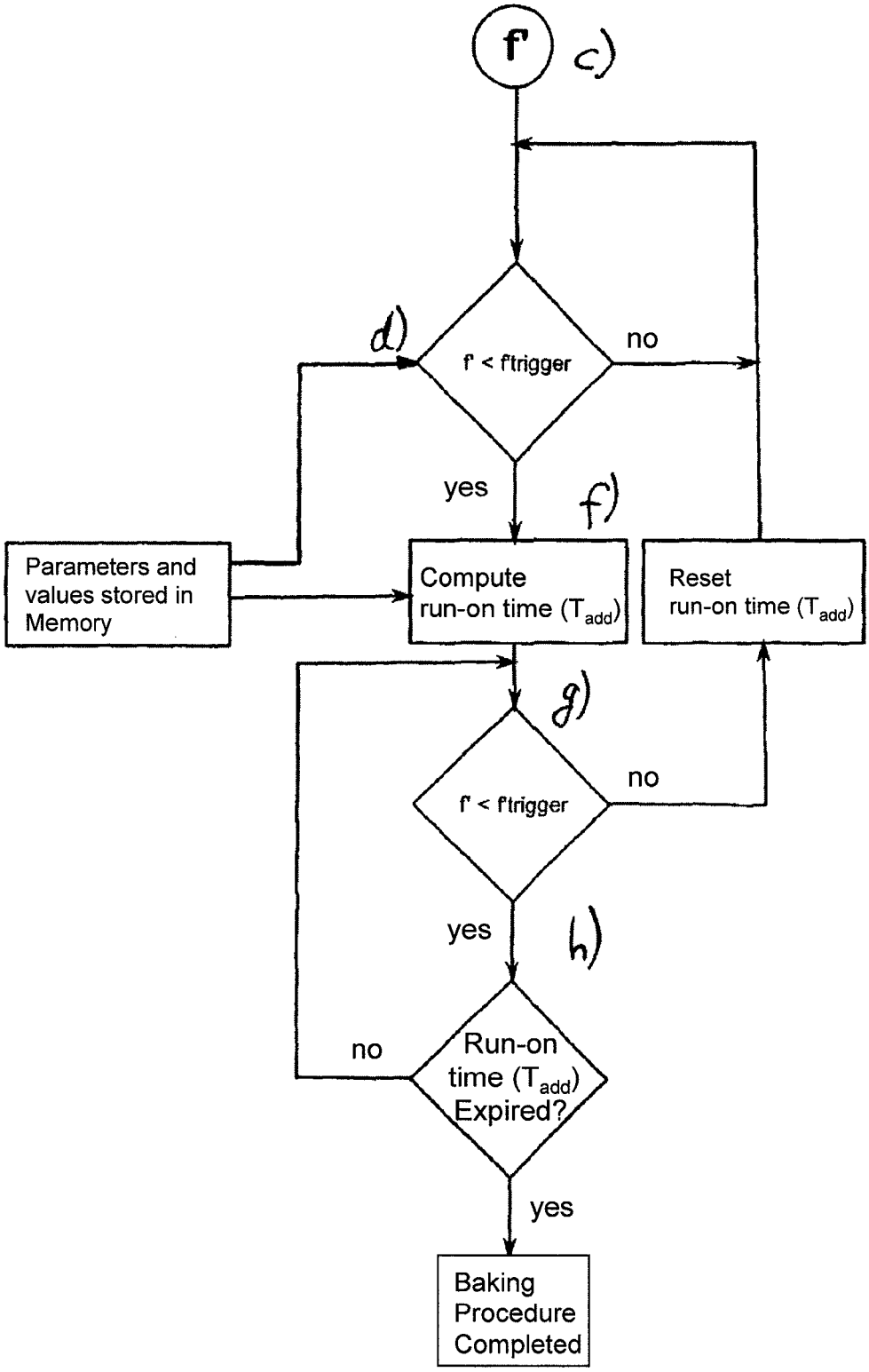
FIG. 5 shows a flow chart for an algorithm of the method according to the invention.

FIG. 5 shows a flow chart for the algorithm of the method according to the invention covering steps a) to h). In particular it is straightforwardly clear therefrom that if, in contrast to step h), the value for "f" once again rises above or reaches the trigger value ($f'_{trigger}$), then the run-on time $T_{add}$ is abandoned and testing in each case for whether the value f has already reached the trigger value ($f'_{trigger}$) is begun again from the beginning. It may furthermore be noted that it is constantly checked whether as it were the trigger condition is violated or whether it is complied with.

The invention claimed is:

1. A method of regulating a cooking process for a foodstuff in a cooking chamber of a cooking appliance with a heating element and a sensor, said method having the following steps:

a) input of a foodstuff indicator to be cooked by an operator into a controller of said cooking appliance;

b) detection by said sensor of a concentration over time of a gas or of moisture escaping from said foodstuff in said cooking chamber after said foodstuff has been introduced;

c) determination of a gradient of a profile of said detected concentration over the course of time;

d) reading out of a trigger value linked to said foodstuff to be cooked for said profile from a memory of said controller;

e) determination of the time at which said trigger value is reached or fallen below;

f) determination of a run-on time linked to a time at which said trigger value is reached for said foodstuff from said memory at said time at which said trigger value is reached, a length of a run-on time being a function of said time at which said trigger value is reached;

g) starting of said run-on time; and h) continuation of said cooking process as a run-on process until said run-on time has elapsed if said value remains below said trigger value.

2. The method according to claim 1, wherein said foodstuff indicator is assigned to a foodstuff group and said foodstuff group or corresponding specifications for determining said run-on time are stored in said controller of said cooking appliance.

3. The method according to claim 2, wherein said foodstuff indicator is always in accordance with how it is assigned to said corresponding associated foodstuff group.

4. The method according to claim 1, wherein said trigger value amounts to approximately 10% to 40% of a maximum value of said gradient.

5. The method according to claim 1, wherein said run-on time amounts to a fixed value of approximately 10 minutes to 15 minutes, for a time at which said trigger value is reached in less than 30 minutes.

6. The method according to claim 1, wherein said run-on time varies relatively slightly for a time at which said trigger value is reached in less than 30 min.

7. The method according to claim 6, wherein said run-on time takes the form of an approximately straight line with a slight gradient.

8. The method according to claim 1, wherein said run-on time decreases when said time at which said trigger value is reached is greater than 20 minutes and is set to zero at the latest for 90 minutes.

9. The method according to claim 1, wherein said run-on time is established in a decreasing region using a monotonically falling curve.

10. The method according to claim 9, wherein said curve is a straight line.

11. The method according to claim 1, wherein, if said run-on time is set at zero, said cooking process is regarded as complete and is terminated.

12. The method according to claim 1, wherein, if said trigger value is reached again or is exceeded, said run-on process is broken off or said run-on time is abandoned and a new, appropriate run-on time is only determined in accordance with steps c)-h) when said trigger value is reached again or fallen below.

* * * * *